United States Patent [19]

Yanagawa et al.

[11] 4,261,560

[45] Apr. 14, 1981

[54] SHEET SEPARATION APPARATUS

[75] Inventors: Nobuyuki Yanagawa, Chigasaki; Mitsuo Tanaka, Sagamihara; Kimio Tanaka, Inagi, all of Japan

[73] Assignee: Ricoh Company, Ltd., Japan

[21] Appl. No.: 971,355

[22] Filed: Dec. 20, 1978

[30] Foreign Application Priority Data

Dec. 21, 1977 [JP] Japan ..... 52-154130
Dec. 23, 1977 [JP] Japan ..... 52-156266

[51] Int. Cl.[3] ..... B65H 29/56

[52] U.S. Cl. ..... 271/308; 271/312; 271/DIG. 2

[58] Field of Search ..... 271/174, DIG. 2, 80, 271/273, 82, 277, 308, 311, 312; 355/3 SH, 3 DR, 14 SH; 101/415.1

[56] References Cited

U.S. PATENT DOCUMENTS

| | | | |
|---|---|---|---|
| 3,811,670 | 5/1974 | Inque | 271/DIG. 2 X |
| 3,820,776 | 6/1974 | Fujimoto et al. | 271/DIG. 2 X |
| 3,918,702 | 11/1975 | Mihalik et al. | 271/174 |
| 3,926,429 | 12/1975 | Satomi et al. | 271/DIG. 2 X |
| 4,065,120 | 12/1977 | Imaizumi et al. | 271/174 |

*Primary Examiner*—Bruce H. Stoner, Jr.
*Attorney, Agent, or Firm*—McGlew and Tuttle

[57] ABSTRACT

The sheet separation apparatus for separating a transfer sheet from a toner image bearing photoconductor for use in an electrophotographic copying machine comprises a plurality of separators which are rotatably mounted on a shaft arranged parallel to the photoconductor, and each of the separators is independently urged into pressure contact with the surface of the photoconductor by a spring member through a control member which is substantially integral with the shaft. In one embodiment of the sheet separation apparatus, the control member serves as a protector for preventing toner particles from being scattered from the surface of the photoconductor and in another embodiment of the sheet separation apparatus, the shaft can be turned about a predetermined point of one end portion of the shaft in the direction that the other end portion of the shaft can be moved away from the photoconductor for easy maintenance of the sheet separation apparatus.

5 Claims, 15 Drawing Figures

FIG. 7
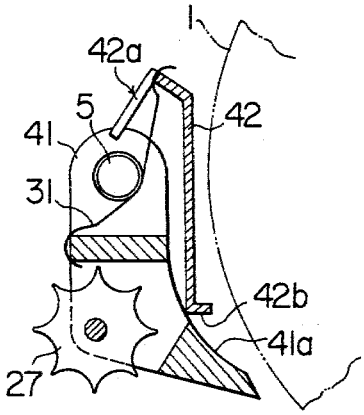
FIG. 10
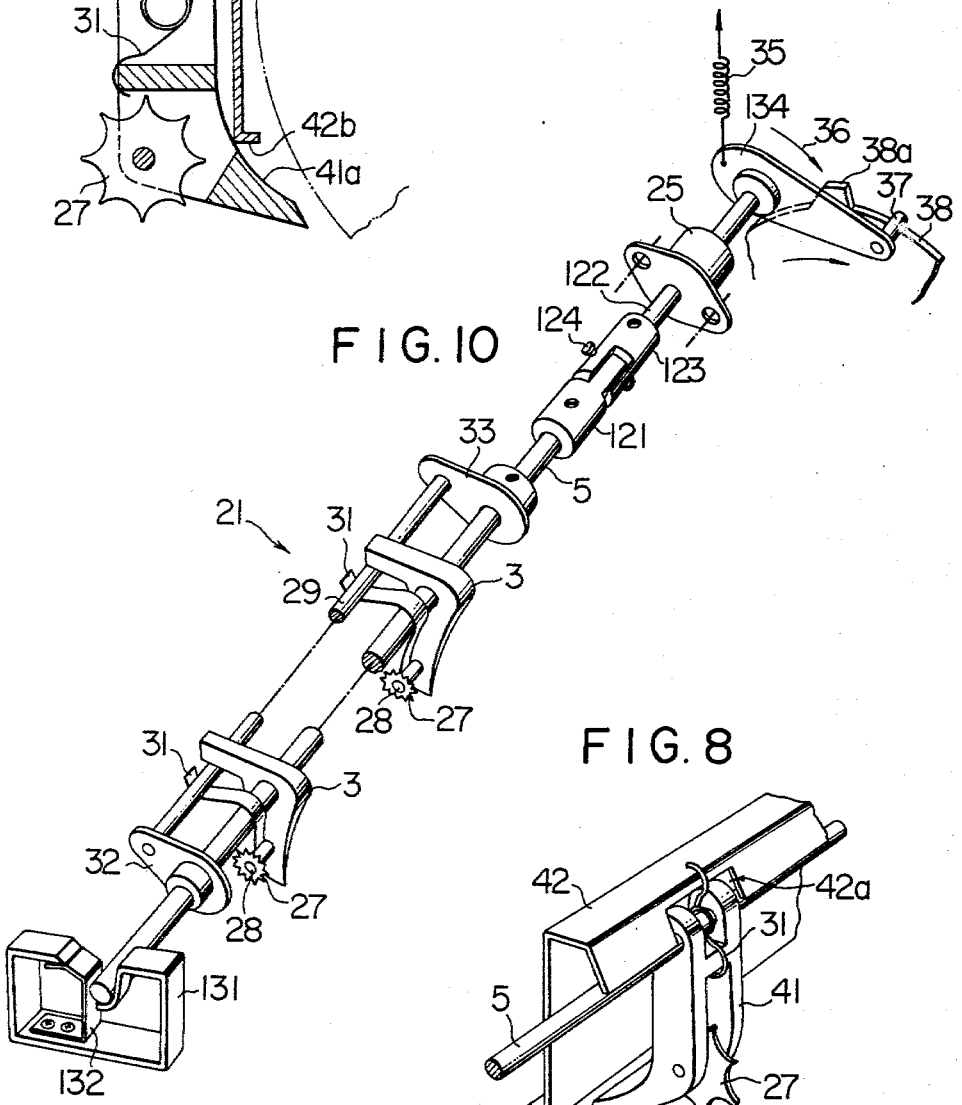
FIG. 8

SHEET SEPARATION APPARATUS

BACKGROUND OF THE INVENTION

The present invention relates to a sheet separation apparatus for use in an electrophotographic copying machine.

In an electrophotographic copying machine, it is necessary to separate a transfer sheet from the peripheral surface of a photoconductor drum after a toner image formed on the drum is transferred to the transfer sheet. Referring to FIGS. 1 and 2, there are shown the conventional methods for performing such separation of a transfer sheet from a photoconductor drum 1. Referring to FIG. 1, when a leading edge of a transfer sheet 2 comes close to a separator 3, an operation shaft 4 is lowered and the separator 3 is rotated on a shaft 5 in the direction of the arrow, so that a top portion of the separator 3 is brought into pressure contact with the photoconductor drum 1 and the sheet 2 is separated from the photoconductor drum 1.

The separator 3 as shown in FIG. 2 is urged to rotate clockwise by the bias of a spring whose one end is fixed to a projection 3*a* of the separator 3 and whose other end is fixed to a pin 6. Normally the separator 3 is held in a position as indicated by long and short dash lines. When the leading edge of the transfer sheet 2 comes close to the separator 3, an operation pin 7 which is rotated together with the drum 1 pushes the projection 3*a* of the separator 3, and the separator 3 is turned to a position as indicated by solid lines, so that the sheet 2 is separated from the drum 1. In the above-mentioned sheet separation apparatus, a plurality of the separators 3 are secured to the shaft 5, so that the separators 3 are integrally operated. Therefore, the top portions of the separator 3 have to be adjusted so as to be arranged in a line accurately. In case the top portions of the separators 3 are irregularly arranged, the sheet separation cannot be performed properly. Furthermore, since each separator 3 is operated rigidly towards the peripheral surface of the drum 1 by the rotation of the shaft 5, occasionally the operation stroke of the separator 3 becomes too great, and when more than a predetermined load is applied to the end portion of each separator 3, there is a risk that the separators 3 and the peripheral surface of the drum 1 are damaged.

Referring to FIG. 3, there is shown part of a copying machine in which a sheet-formed photoconductor 8 is wound around the peripheral surface of the drum 1. One end portion of the photoconductor 8 is in pressure contact with a concave portion of the drum 1 by a holding member 11 whose base portion is rotatably mounted on a shaft 9. The other end portion of the photoconductor 8 is in pressure contact with the concave portion of the drum 1 by a clamp member 12. In the copying machine of this type, it is necessary to prevent a portion of the photoconductor 8 capable of forming images from being damaged by the separator 3 with the transfer sheet 2 advanced up to a photoconductor clamping portion. In this case, if the top portion of the separator 3 is acute, the separator 3 is pushed towards the shaft 5 as indicated by the arrow when the top portion of the separator 3 is at a slanting surface of the clamping portion, resulting in that the separator 3 is damaged.

Furthermore, in the conventional sheet separation apparatus, a sheet separation unit is secured to the body of the copying machine and plural separators 3 which are made substantially integral are brought into contact with the peripheral surface of the drum 1 or moved away from the drum 1. Therefore, when a sheet is jammed in the sheet separation portion, it is very difficult to remove the jammed sheet and to fix the sheet separation portion. Furthermore, since the separators 3 are fixed to the shaft 5, when an unusual load is applied to the separators 3, the separators 3 are apt to be damaged.

Furthermore, in the copying machine of the type as shown in FIG. 3, when the leading edge of the transfer sheet is curled or charged electrically so as to be in close contact with the clamp member 12, the separator 3 sometimes fails to enter between the sheet 2 and clamp member 12 so that the sheet is jammed.

SUMMARY OF THE INVENTION

It is therefore a primary object of the present invention to provide an improved sheet separation apparatus capable of separating the transfer sheet from a photoconductor securely.

Another object of the present invention is to provide an improved sheet separation apparatus capable of eliminating a risk of damaging sheet separating members and the photoconductor by a jammed sheet.

A further object of the invention is to provide an improved sheet separation apparatus capable of preventing toner particles remaining on the photoconductor from being scattered after separation of each sheet from the photoconductor.

A still further object of the invention is to provide an improved sheet separation apparatus capable of removing jammed sheet from the sheet separation apparatus easily when transfer sheet is jammed.

In one embodiment of a sheet separation apparatus according to the invention, plural separators are rotatably supported on a shaft and each separator is independently brought into pressure contact with a photoconductor drum, so that improper sheet separation as caused by irregular line-up of the top portions of the separators can be eliminated. In the top portion of each separator, there is formed an edge portion which extends along the circumferential surface of the drum, which prevents each separator from being damaged when an abnormal load is applied to the separator.

In another embodiment of the invention, a sheet separation apparatus can be turned so as to move away from the photoconductor drum. Therefore, repairment, adjustment and maintenance of the sheet separation apparatus can be easily performed, for instance, in case of sheet jamming.

In a further embodiment of the invention, a control means which controls the movement of the separators is used as a means for preventing the scattering of the toner to be removed from the photoconductor drum. The control means also serves to fix the position of each separator on the shaft for supporting each separator.

BRIEF DESCRIPTION OF THE DRAWINGS

FIG. 7 is a schematic sectional view of another embodiment of a sheet separation apparatus of the invention.

FIG. 8 is a schematic perspective view of the sheet separation apparatus of FIG. 7.

FIG. 10 is a perspective view of the sheet separation apparatus of FIG. 9.

Throughout the drawings and the following detailed description of the invention, substantially the same members or apparatuses are given the same reference numerals.

DETAILED DESCRIPTION OF THE PREFERRED EMBODIMENTS

Figure 1:
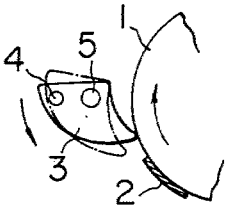
FIG. 1 PRIOR ART
FIG. 1 is a schematic sectional view of a conventional sheet separation apparatus.
Figure 2:
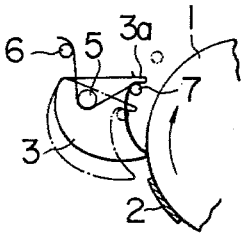
FIG. 2 PRIOR ART
FIG. 2 is a schematic sectional view of another conventional sheet separation apparatus.
Figure 3:
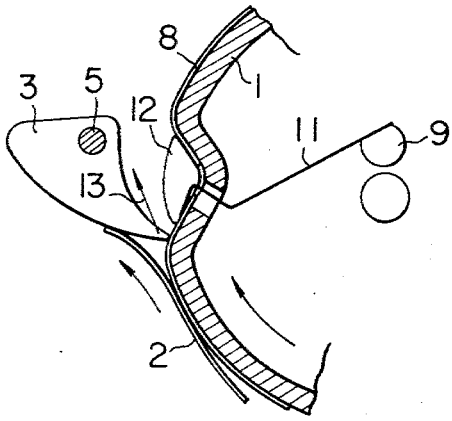
FIG. 3 PRIOR ART
FIG. 3 is a schematic sectional view of a further sheet separation apparatus.
Figure 4:
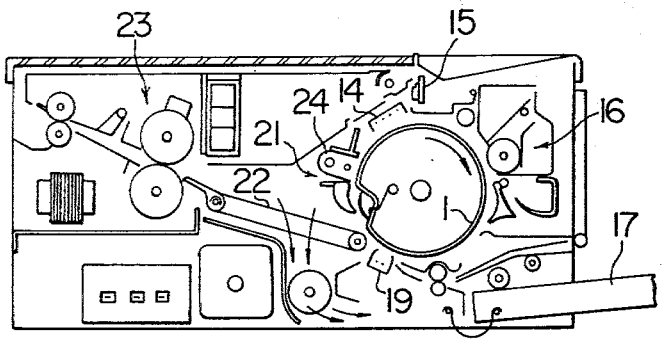
FIG. 4 is a schematic sectional view of a copying machine in which one type of an embodiment of a sheet separation apparatus of the invention is employed.

Referring to FIG. 4, there is shown an example of a copying machine employing an embodiment of a sheet separation apparatus according to the present invention. In FIG. 4, a photoconductor 8 (refer to FIG. 5) of a drum 1, which is rotated in the direction of the arrow, is charged, exposed, developed by a charging apparatus 14, an exposure apparatus 15, and a development apparatus 16, respectively, whereby a toner image is formed on the photoconductor 8. By an image transfer apparatus 19, the toner image is transferred to a sheet 2 (see FIG. 5) fed from a sheet feed tray 17. The toner image bearing sheet 2 is separated from the drum 1 and is then transported to an image fixing apparatus 23 by a transfer belt 22 and discharged from the copying machine. After image transfer, the photoconductor 8 is quenched by a quenching apparatus 24, so that toner remaining on the photoconductor 8 is removed.

Figure 6:
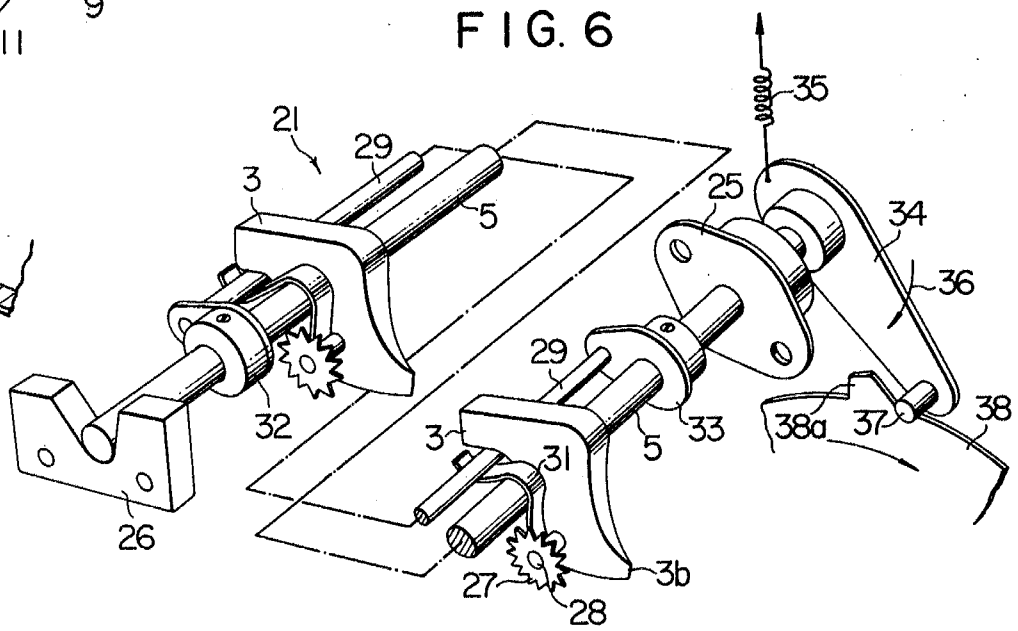
FIG. 6 is a perspective view of the sheet separation apparatus of FIG. 5.
Figure 5:
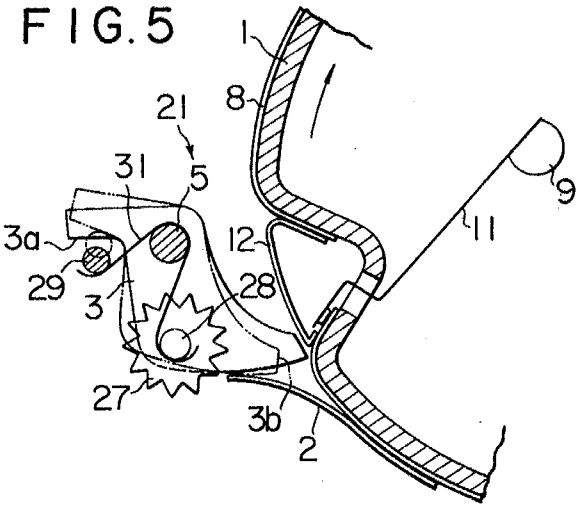
FIG. 5 is a schematic sectional view of one embodiment of a sheet separation apparatus according to the invention.

FIGS. 5 and 6 show an example of a sheet separation apparatus 21 according to the invention. Plural separators 3 are rotatably mounted on a shaft 5. One end of the shaft 5 is rotatably supported by a bearing member 25 fixed to a side plate (not shown) and the other end of the shaft 5 is supported on a bearing member 26 having a notch portion, which is fixed to the other side plate (not shown). A spur 27 is pivotally mounted on a pin 28 secured to each separator 3. The spur 27 is for guiding the sheet 2 after it is separated from the drum 1. Each separator 3 is biased to rotate in the direction that a tip of the separator 3 comes closer to the peripheral surface of the drum 1 by the bias of a spring 31 whose one end is stopped by a control shaft 29 and whose other end is stopped by the pin 28. Normally the separator 3 is held in a position as shown by long and two short dash lines in FIG. 5 with a lower end 3*a* of the separator 3 being in contact with the control shaft 29, so that the tip of the separator 3 is positioned away from the peripheral surface of the drum 1. The opposite ends of the control shaft 29 are secured to the end portions of arm members 32 and 33 which are secured to the shaft 5. A base portion of an operation lever 34 is fixed to the one end of the shaft 5. A taut spring 35 has one end connected to the operation lever 34 and other end connected to a fixed member (not shown). The taut spring 35 biases operation lever 34 to rotate in the direction of the arrow 36, so that a pin 37 secured to a free end of the operation lever 34 is brought into pressure contact with the peripheral surface of a cam 38 which is secured to the drum 1.

When a tip portion of the sheet 2 comes close to the separator 3 as the drum 1 is rotated in the direction of the arrow, the pin 37 is pushed upwards by a projection 38*a* of the cam 38 which rotates together with the drum 1. The operation lever 34 is thereby rotated in the opposite direction to the arrow 36, so that the shaft 5 is rotated counterclockwise in FIG. 5. As a result, the control shaft 29 is lowered from the position shown by long and short two dash lines to the position shown by solid line. At the same time, the separator 3 is rotated counterclockwise and the tip portion of the separator 3 is brought into pressure contact with the peripheral surface of the drum 1, so that the sheet 2 is separated from the peripheral surface of the drum 1. The operation of the separator 3 being brought into pressure contact with the peripheral surface of the drum 1 continues for a short time while the pin 37 is engaged by the projection 38*a* of the cam 38. In other words, the operation continues until only the top portion of the sheet 2 has been separated from the peripheral surface of the drum 1. Thereafter, the separator 3 is retracted from the peripheral surface of the drum 1. The operation is performed whenever each sheet 2 is fed with one rotation of the drum 1.

Since each separator 3 is independently in pressure contact with the peripheral surface of the drum 1 by the spring 31, each separator 3 can independently follow the peripheral surface of the drum 1, so that improper sheet separation as caused by the irregurality of the top portions of the separators 3 can be obviated and the scattering of the operation stroke of each separator 3 can also be absorbed. Furthermore, in the top portion of each separator 3, there is formed an edge portion 3*b* extending in the circumferential direction of the drum 1. Therefore, when a load is applied to the separator 3, the separator 3 is rotated about the shaft 5 and is retracted from the peripheral surface of the drum 1, whereby the damage of separator 3 can be prevented.

Referring to FIGS. 7 and 8, there is shown another embodiment of a sheet separation apparatus of the present invention. In FIGS. 7 and 8, each separator 41 is shaped like a fork. In the middle portion of the separator 41, there is arranged the spur 27. In this apparatus, a control member 42 is employed instead of the control shaft 29, and the opposite ends of the spring 31 are stopped by the separator 41 and by a notch 42*a* formed in the control member 42. As shown in FIG. 8, an upper portion of the separator 41 is fitted in a notch 42*a* of the control member 42, so that the separator 41 is fixed by the control member 42 so as not move along the shaft 5. Conventionally, the separators of this type are fixed by E-rings, but it is not always easy to fix the separator 41 by E-rings. Furthermore, the E-rings are expensive. These disadvantages are eliminated by use of a control member 42 as a fixing member for the separator 41. The control member 42 is fixed to the shaft 5, and a side edge 41*a* of the separator 41 is in pressure contact with a lower end portion 42*b* of the control member 42 by the bias of the spring 31, so that, when the shaft 5 and the control member 42 which is substantially integral with the shaft 5 are rotated counterclockwise (in respect to FIG. 7) by the cams 38 and the operation lever 34, the separator 41 follows the control member 42 and rotates in the same direction and the top portion of the separator 41 is brought into pressure contact with the peripheral surface of the drum 1. Thus, the sheet 2 is separated from the drum 1. Toner which remains on the drum 1, after a toner image has been transferred to the sheet 2 and the sheet 2 has been separated from the drum 1, is very unstable. In the meanwhile, since the sheet 2 is sucked to the sheet transport belt 22 by a fan, air flows near the sheet separating portion. As a result, toner is scattered within the copying machine and occasionally the scattered toner stays on the sheet transport belt 22. This may lower the sheet transport efficiency and smears the back side of the sheet 2 and occasionally the toner is scattered out of the copying machine.

In order to prevent such adverse effects of the toner, instead of the control shaft 29, the control member 42 is employed which covers the sheet separating portion 21 and the quenching portion 24 (see FIG. 4) and a part of the peripheral surface of the drum 1. Therefore, the control member 42 serves not only to control the operation and positioning of the separator 41 but also to prevent toner from being scattered.

Figure 9:
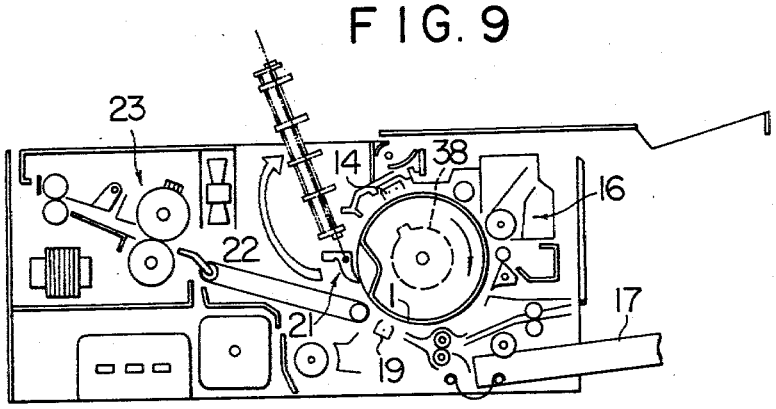
FIG. 9 is a schematic sectional view of another copying machine in which another type of an embodiment of a sheet separation apparatus of the invention is employed.
Figure 11:
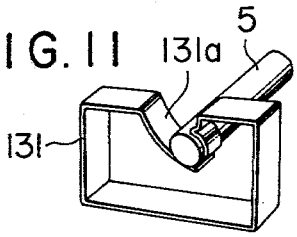
FIG. 11 is a perspective view of a holder for the sheet separation apparatus of FIG. 9.

Referring to FIG. 9, there is shown a copying machine in which a further embodiment of the present invention is employed. The copying machine of FIG. 9 is substantially the same as that shown in FIG. 4. FIG. 10 shows perspectively the sheet separation apparatus shown in FIG. 9. This sheet separation apparatus is substantially the same as the apparatus as shown in FIG. 3 through FIG. 6 except the following. In one end portion of the shaft 5, there is provided a joint member 121. By a pin 124, the joint member 121 is connected to a counterpart joint member 123 which is mounted on a shaft 122, so that the main portion of the sheet separation apparatus 21 can be turned about the pin 124 so as to move away from the peripheral surface of the drum 1. A holder 131 for holding the other end portion of the shaft 5 is fixed to a side plate (not shown). A part of the holder 131 is open so as to hold the end portion of the shaft 5 therein. The shaft 5 is brought into pressure contact with an arc portion of the holder 131 by a free end of a plate spring 132 whose base portion is fixed to the holder 131, so that the shaft 5 can be attached to and detached from the holder 131 by pushing the shaft 5 into the holder 131 manually. As shown in FIG. 11, in case a spring portion 131*a* is formed in the holder 131, the shaft 5 can be detachably held by the holder 131 without using the plate spring 132.

As mentioned previously, the main portion of the sheet separation apparatus can be turned about the pin 124 as shown in FIG. 9. Thus, removal of jammed sheet and resetting of the sheet separation apparatus at a predetermined position can be performed easily.

Figure 12:
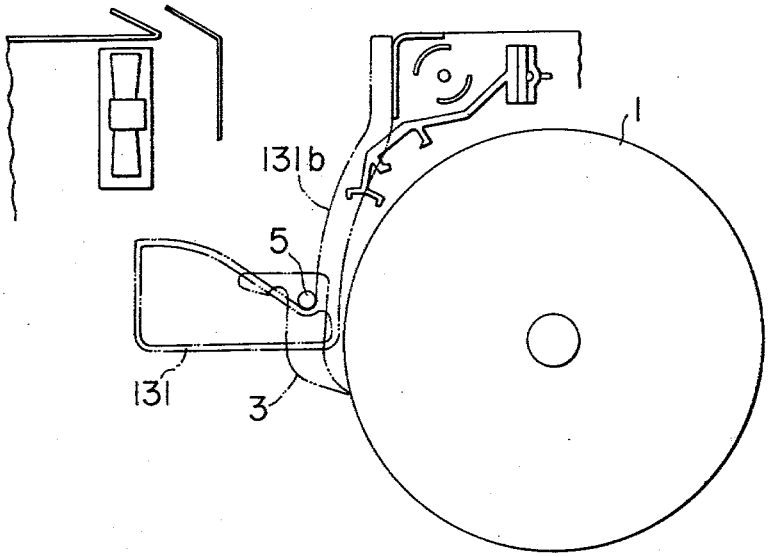
FIG. 12 is a schematic sectional view of another holder for the sheet separation apparatus of FIG. 9.

In case the joint members 121 and 123 can be turned universally, the sheet separation apparatus 21 can be detached by turning in a desired direction. Therefore, removal of the jammed sheet and resetting of the sheet separation apparatus can be performed much more easily. In this case, by providing a long guide member 131*b* as shown in FIG. 12, it can be prevented that the separator 3 damages the photoconductor when the sheet separation apparatus 21 is reset.

Figure 13:
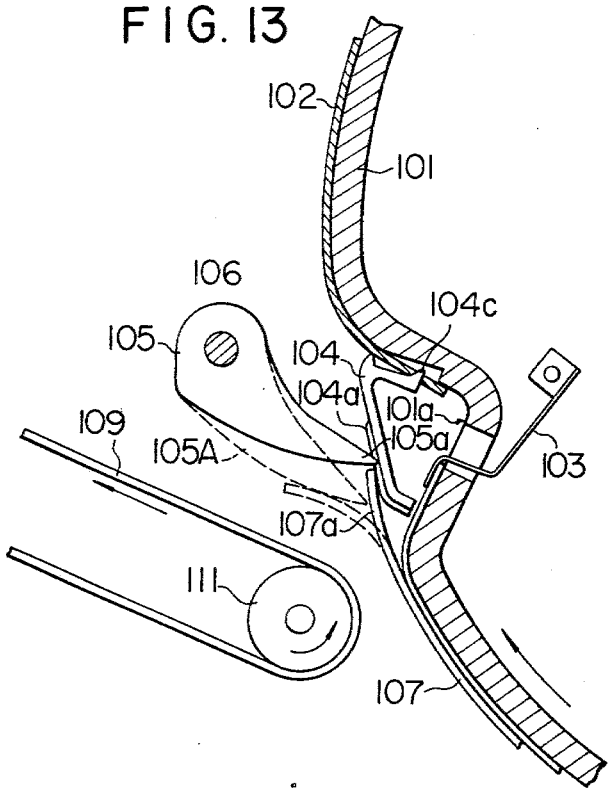
FIG. 13 is a schematic sectional view of an auxiliary sheet separation device for the sheet separation apparatus of the invention.
Figure 14:
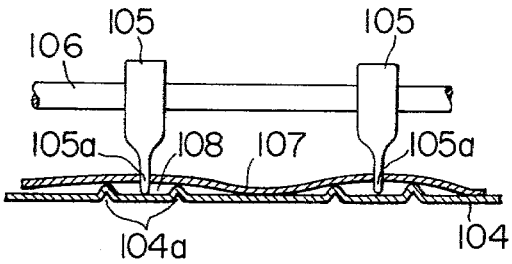
FIG. 14 is a schematic sectional view of a clamp member for clamping a photoconductor sheet to a drum, which can be employed in the auxiliary sheet separation device of FIG. 13.
Figure 15:
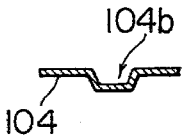
FIG. 15 is a schematic sectional view of another clamp member for clamping a photoconductor sheet to a drum, which can be employed in the auxiliary sheet separation device of FIG. 13.

In FIG. 13, a photoconductor sheet 102 is wound around a drum 101 which is rotated in the direction of the arrow. The leading edge of the conductor sheet 102 is in pressure contact with a concave portion 101*a* formed in the peripheral surface of the drum 101 by a free end of a holding member 103 whose base portion is pivotally mounted on a side portion of the drum 101. The rear end portion of the sheet 102 is also in pressure contact with the concave portion 101*a* by plural projections 104*c* of a clamp member 104. The clamp member 104 is disposed in the concave portion 101*a* and serves to clamp the photoconductor 102 as well as to cover the concave portion 101*a*. In the clamp member 104, there are formed plural convex portions 104*a* as shown in FIG. 14 or plural concave portions 104*b* as shown in FIG. 15. Referring back to FIG. 13, each separator 105 is secured to a shaft 106 and normally the separator 105 is positioned as indicated by broken lines 105A. When the leading edge of a transfer sheet 107 approaches to the separator 105, the separator 105 is turned to a position as indicated by solid lines, so that a top portion 105*a* of the separator 105 is brought into pressure contact with the clamp member 104. The separator 105 comes in contact with the clamp member 104 for a short time for separating the sheet 107 from the photoconductor 102, but the separator 105 does not contact with the photoconductor 102. In this device, even if the leading edge 107*a* of the sheet 107 is curled so as to be in close contact with the clamp member 104, since gaps 108 are formed between the sheet 107 and the clamp member 104 by the convex portions 104*a* or the concave portions 104*b* formed in the clamp member 104, the top portion 105*a* of the separator 105 can be surely inserted between the sheet 107 and the clamp member 104, whereby the leading edge 107*a* of the sheet 107 can be securely separated from the photoconductor sheet 102. After the leading edge 107*a* of the sheet 107 is separated from the photoconductor sheet 102, the sheet 107 is guided along a lower portion of the separator 105 onto a transfer belt 109 which is rotated in the direction of the arrow by a pair of roller 111 and the sheet 107 is transported to an image fixing station (not shown).

What is claimed is:

1. An apparatus for separating a receiving sheet from a rotatable drum having a photoconductor surface, comprising a rotatable shaft, a plurality of separators mounted to said rotatable shaft at spaced locations along the length thereof for rotation relative thereto, a control shaft adjacent said rotatable shaft, support means supporting said control shaft for revolving movements about said rotatable shaft, each of said separators having a tip portion extending outwardly from said rotatable shaft and directed toward the photoconductor surface of the drum, a pin on each separator, a spring engaged around said rotatable shaft and having one end engaged around said pin and an opposite end engaged around said control shaft, said control shaft being movable against the force of said spring and being urged by said spring to engage said separators to rotate said separators in a direction to move each tip portion away from said photoconductor surface, a cam arm connected to said rotatable shaft for rotation therewith, a cam adjacent said cam arm and engagable therewith, biasing means biasing said cam arm into engagement with said cam and in a direction to rotate said rotatable shaft with said separators to move said tip portion of each separator away from the drum, said cam being movable in accordance with the movement of a sheet around the drum to move said cam arm against said biasing means and to move said control shaft in a direction to permit said tip portion of each separator to move toward the photoconductor surface to deflect the sheet away from the surface, a spur guide on each of said separators in a position to deflect said sheet outwardly after it is engaged by said separators, each separator being in pressure contact with said photoconductor surface so that it can independently follow the peripheral surface of the drum, each separator having an edge portion adjacent said tip portion extending substantially in the circumferential direction of the drum, the drum having a recess portion in the periphery thereof, a clamp member in said recess portion having a plurality of outwardly extending portions spaced along the length thereof deflecting a sheet which is fed thereover outwardly from the surface of the drum and the tip portions of said separators being operative to enter into the space provided by said clamp between said projections to engage beneath a sheet fed thereover so as to deflect it outwardly.

2. In a sheet separation apparatus of the type having a plurality of separators mounted on a shaft for separating a transfer sheet from a photoconductor in a copying machine in which an image is formed on said photoconductor and is transferred to said transfer sheet, the improvement wherein each of said separators is arranged along the surface of said photoconductor and, further comprising spring means for independently and selectively urging each of said separators into engagement with the surface of the photoconductor for separating the transfer sheet from the photoconductor, each of said separators being rotatably mounted on said shaft which extends parallel to the surface of said photoconductor, means for controlling the rotation of each of the separators substantially integral with said shaft, said control means being connected to each of the separators through said spring means, and each of the separators having an upper portion with an edge portion which extends along the surface of said photoconductor in the rotating direction of said photoconductor, wherein said control means is a plate which extends between said separators and the surface of said photoconductor and which prevents toner particles from being scattered from the surface of said photoconductor.

3. A sheet separation apparatus as claimed in claim 2 wherein said plate has a plurality of notches for setting the position of each of said separators on said shaft.

4. An apparatus for separating a receiving sheet from a rotatable drum having a photoconductor surface, comprising a rotatable shaft, a plurality of separators mounted to said rotatable shaft at spaced locations along the length thereof for rotation relative thereto, a control shaft adjacent said rotatable shaft, support means supporting said control shaft for revolving movement about said rotatable shaft, each of said separators having a tip portion extending outwardly from said rotatable shaft and directed toward the photoconductor surface of the drum, a pin on each separator, a spring engaged around said rotatable shaft and having one end engaged around said pin and an opposite end engaged around said control shaft, said control shaft being movable against the force of said spring and being urged by said spring to engage said separators to rotate said separators in a direction to move each tip portion away from said photoconductor surface, a cam arm connected to said rotatable shaft for rotation therewith, a cam adjacent said cam arm and engageable therewith, biasing means biasing said cam arm into engagement with said cam and in a direction to rotate said rotatable shaft with said separators to move said tip portion of each separator away from the drum, said cam being movable in accordance with the movement of a sheet around the drum to move said cam arm against said biasing means and to move said control shaft in a direction to permit said tip portion of each separator to move toward the photoconductor surface to deflect the sheet away from the surface, each separator being in pressure contact with said photoconductor surface so that it can independently follow the peripheral surface of the drum, each separator having an edge portion adjacent said tip portion extending substantially in the circumferential direction of the drum, and wherein each of said separators comprises a bifurcated member including two spaced apart leg portions and including a spur guide mounted between said leg portions being in a position to guide the sheet away from the drum after it is lifted off by said separator and, said control shaft comprising a shield member forming a shield preventing the scattering of toner which remains on the drum following image transfer to the sheet.

5. An apparatus for separating a receiving sheet from a rotatable drum having a photoconductor surface, comprising a rotatable shaft, a plurality of separators mounted to said rotatable shaft at spaced locations along the length thereof for rotation relative thereto, a control shaft adjacent said rotatable shaft, support means supporting said control shaft for revolving movement about said rotatable shaft, each of said separators having a tip portion extending outwardly from said rotatable shaft and directed toward the photoconductor surface of the drum, a pin on each separator, a spring engaged around said rotatable shaft and having one end engaged around said pin and an opposite end engaged around said control shaft, said control shaft being movable against the force of said spring and being urged by said spring to engage said separators to rotate said separators in a direction to move each tip portion away from said photoconductor surface, a cam arm connected to said rotatable shaft for rotation therewith, a cam adjacent ssid cam arm and engageable therewith, biasing means biasing said cam arm into engagement with said cam and in a direction to rotate said rotatable shaft with said separators to move said tip portion of each separator away from the drum, said cam being movable in accordance with the movement of a sheet around the drum to move said cam arm against said biasing means and to move said control shaft in a direction to permit said tip portion of each separator to move toward the photoconductor surface to deflect the sheet away from the surface, each separator being in pressure contact with said photoconductor surface so that it can independently follow the peripheral surface of the drum, each separator having and edge portion adjacent said tip portion extending substantially in the circumferential direction of the drum, and wherein said rotatable shaft includes first and second separable portions between said cam arm and said separators and joint means interconnecting said portions permitting pivotal movement of one portion about the other about an axis perpendicular to the axis of the shaft, whereby to facilitate the removal of said separators from the drum when a sheet becomes jammed.

* * * * *